US009518318B2

(12) United States Patent
Heuer et al.

(10) Patent No.: US 9,518,318 B2
(45) Date of Patent: Dec. 13, 2016

(54) METHOD AND DEVICE FOR HARDENING WORK PIECES AND WORKPIECES HARDENED ACCORDING TO SAID METHOD

(75) Inventors: Volker Heuer, Frankfurt (DE); Klaus Loeser, Mainhauser (DE); Gunther Schmitt, Hanau (DE); Gerhard Welzig, Frankfurt (DE)

(73) Assignee: ALD Vacuum Technologies GmbH, Hanau (DE)

( * ) Notice: Subject to any disclaimer, the term of this patent is extended or adjusted under 35 U.S.C. 154(b) by 183 days.

(21) Appl. No.: 13/394,795

(22) PCT Filed: Sep. 6, 2010

(86) PCT No.: PCT/EP2010/005456
§ 371 (c)(1),
(2), (4) Date: Mar. 7, 2012

(87) PCT Pub. No.: WO2011/029565
PCT Pub. Date: Mar. 17, 2011

(65) Prior Publication Data

US 2012/0168033 A1 Jul. 5, 2012

(30) Foreign Application Priority Data

Sep. 10, 2009 (DE) ..... 10 2009 041 041

(51) Int. Cl.

| | |
|---|---|
| ***C23C 8/02*** | (2006.01) |
| ***C23C 8/06*** | (2006.01) |
| ***C23C 8/20*** | (2006.01) |
| ***C23C 8/22*** | (2006.01) |
| ***C23C 8/24*** | (2006.01) |
| ***C23C 8/26*** | (2006.01) |
| ***C23C 8/80*** | (2006.01) |

(52) U.S. Cl.
CPC . *C23C 8/02* (2013.01); *C23C 8/06* (2013.01); *C23C 8/20* (2013.01); *C23C 8/22* (2013.01); *C23C 8/24* (2013.01); *C23C 8/26* (2013.01); *C23C 8/80* (2013.01)

(58) Field of Classification Search
CPC ..... C23C 8/06; C23C 8/20; C23C 8/34
USPC ..... 148/206, 218, 223, 238
See application file for complete search history.

(56) References Cited

U.S. PATENT DOCUMENTS

| | | | | |
|---|---|---|---|---|
| 3,575,398 | A | 4/1971 | Lincoln et al. | |
| 4,653,732 | A * | 3/1987 | Wunning et al. | 266/250 |
| 2003/0113186 | A1* | 6/2003 | Hiramoto | 414/147 |
| 2005/0098553 | A1* | 5/2005 | Devine et al. | 219/411 |

FOREIGN PATENT DOCUMENTS

| | | |
|---|---|---|
| DE | 41 32 712 A1 | 4/1993 |
| DE | 43 18 400 C1 | 6/1994 |
| DE | 198 29 825 A1 | 1/1999 |
| DE | 103 22 255 A1 | 12/2004 |
| DE | 103 59 554 B4 | 7/2005 |

(Continued)

*Primary Examiner* — Alexander Polyansky
(74) *Attorney, Agent, or Firm* — ProPat, L.L.C.

(57) ABSTRACT

The invention relates to a method and device for thermally treating workpieces, the device including a cooling chamber and two or more carburizing chambers in which the work pieces are heated to a temperature of 950 to 1200° C. by means of direct heat radiation from a heating device.

12 Claims, 12 Drawing Sheets

(56) References Cited

FOREIGN PATENT DOCUMENTS

| | | | |
|---|---|---|---|
| DE | 10 2006 048 434 | A1 | 6/2008 |
| DE | 20 2008 010215 | U1 | 11/2008 |
| DE | 10 2007 038 991 | A1 | 2/2009 |
| DE | 10 2007 047 074 | A1 | 4/2009 |
| EP | 0 422 353 | A2 | 4/1991 |
| EP | 1 236 810 | A1 | 9/2002 |
| EP | 1 247 875 | A2 | 10/2002 |
| EP | 1 333 105 | A1 | 8/2003 |
| JP | 63033552 | | 2/1988 |

* cited by examiner

METHOD AND DEVICE FOR HARDENING WORK PIECES AND WORKPIECES HARDENED ACCORDING TO SAID METHOD

CROSS-REFERENCE TO RELATED APPLICATIONS

This application is being filed under Rule 1.371 as a National Stage Application of pending International Application No. PCT/EP2010/005456 filed Sep. 6, 2010, which claims priority to the following parent application: German Patent Application No. 10 2009 041 041.4, filed Sep. 10, 2009. International Application No. PCT/EP2010/005456 and German patent application No. 10 2009 041 041.4 are both hereby incorporated by reference herein in their entirety.

FIELD OF INVENTION

The present invention relates to a method for hardening workpieces, to a device for carrying out the method and to workpieces hardened according to the method. The method according to the invention comprises the following steps:

(a) the workpieces are heated to a temperature of 950 to 1200° C.;
(b) the workpieces are subjected to a carbon-containing gas and/or a nitrogen-containing gas at a temperature of 950 to 1200° C. and a pressure of less than 100 mbar;
(c) the workpieces are held in an atmosphere at a pressure of less than 100 mbar at a temperature of 950 to 1200° C.;
(d) if appropriate, steps (b) and (c) are repeated once or several times; and
(e) the workpieces are cooled.

BACKGROUND OF THE INVENTION

A device according to the invention comprises two or more carburizing chambers, at least one cooling chamber and a transfer system for handling racks for workpieces, wherein each of the carburizing chambers can be connected to the cooling chamber via one or more vacuum gate valves or thermal insulation gate valves, and each carburizing chamber has a receptacle for a rack and also heating elements.

The workpieces are primarily parts of machines and gearing mechanisms which are made of metallic materials, for example hollow wheels, gear wheels, shafts or injection components made of steel alloys such as 28Cr4 (in accordance with ASTM 5130), 16MnCr5, 18CrNi8 and 18CrNiMo7-6.

Methods and devices for hardening workpieces by means of carburizing are known in the prior art.

DE 103 22 255 A1 discloses a method for carburizing steel parts at temperatures above 930° C. with a carbon donor gas within a treatment chamber which can be evacuated, wherein nitrogen-releasing gas, such as ammonia, is fed into the treatment chamber both during the heating phase and during the diffusion phase.

DE 103 59 554 B4 describes a method for carburizing metallic workpieces in a vacuum furnace, wherein the furnace atmosphere contains a carbon carrier which, under the process conditions for the carburizing, is cleaved with the release of pure carbon, wherein the carbon carrier is supplied in pulsed fashion, each carburizing pulse is followed by a diffusion pause and the amount of hydrocarbon to be supplied during a carburizing pulse is varied in such a way that it is adapted to the present capacity of the material, to which end the volumetric flow rate of acetylene at the start of each carburizing pulse is dimensioned to be high, and the concentration of hydrogen and/or acetylene and/or total carbon which prevails in the furnace atmosphere or in the off-gas is measured, and according to this the volumetric flow rate of acetylene is appropriately lowered.

DE 10 2006 048 434 A1 relates to a carburizing method which is performed in a protective gas or treatment atmosphere in a heat-treatment furnace, wherein an alcohol and carbon dioxide are introduced into the heat-treatment furnace and reacted chemically. Ethanol and carbon dioxide are introduced into the heat-treatment furnace, wherein the ratio of introduced ethanol to introduced carbon dioxide is preferably 1:0.96. A heat-treatment atmosphere which is produced in such a manner is suitable in particular for the carburization and carburization-neutral annealing of metallic materials, for example iron materials.

DE 10 2007 038 991 A1 describes a rotary hearth furnace for the heat treatment of workpieces, in particular for the gas carburization of metallic workpieces, comprising a furnace chamber, a rotary hearth which bounds the furnace chamber at the bottom, an outer wall which laterally surrounds the furnace chamber and a cover plate which bounds the furnace chamber at the top, wherein the furnace chamber is subdivided into at least two treatment zones with inner walls, which extend radially with respect to an axis of rotation of the rotary plate. For the treatment of workpieces, a plurality of radially chargeable racks which are oriented radially with respect to the axis of rotation of the rotary plate and are intended to receive workpieces or workpiece carriers are arranged on the rotary plate, wherein each inner wall has a passage which is shaped in a manner complementary to the racks and through which the racks can be guided through the respective inner wall when the rotary plate rotates in the circumferential direction.

DE 10 2007 047 074 A1 whose equivalent is U.S. Patent Publication No. 2011/0277887A1 discloses a method for carburizing steel workpieces, in particular workpieces having outer and inner surfaces, wherein the workpiece is held at a temperature in the range of 850 to 1050 ° C. in an atmosphere containing gaseous hydrocarbon. At least two different gaseous hydrocarbons are used and/or the-workpiece is held alternately during a carburizing pulse in the atmosphere containing the gaseous hydrocarbon and during a diffusion phase in an atmosphere which is free of hydrocarbon.

The methods which are known in the prior art have one or more of the following disadvantages:

the temperature which is required to harden workpieces by means of carburization is more than 850° C., with times of more than 45 min usually being required for heating. In order to achieve a sufficient productivity or a high throughput of workpieces, the carburization is effected in batch-wise fashion with a large number of workpieces, which are arranged in a plurality of layers arranged one above another in a charging rack. By way of example, a charging rack having 10 grills is loaded in total with 160 hollow wheels made of a 28Cr4 alloy (in accordance with ASTM 5130), with 16 hollow wheels being arranged alongside one another on each of the 10 grills. Typical charges or charging racks have a dimension in the range of 400 mm up to 2000 mm in each of the three spatial directions. Here and in the text which follows, this conventional type of charging is also denoted by the term "3D charge". In the production sequence, the carburization follows the substantially serial machining (the so-called soft machining).

To this end, provision is made of buffer regions, in which the soft-machined workpieces are collected until a 3D charge for carburization is completed. The carburization of 3D charges takes up considerable areas both for the heating furnace and for the buffer region. In addition, it interrupts the quasi-continuous flow of the machining and leads to additional expenditure for logistics. Thus, the buffering of 3D charges requires the manual handling of workpieces, because robot systems which are suitable for this purpose cannot be used for technical and economical reasons;

the carburization of 3D charges leads to the increased formation of carbon-containing residues, which can contaminate the workpieces and also the surrounding production line;

workpieces carburized in 3D charges generally experience considerable thermal distortion, which makes complex remachining (the so-called hard machining) necessary;

workpieces carburized in 3D charges have a broad variation in characteristic properties, such as the carburization depth, the surface carbon content and the core hardness, and therefore it is not possible to improve characteristic quality values which are influenced directly or indirectly thereby, for example the slip or frictional loss of a mechanical gearing mechanism which is composed of carburized parts.

SUMMARY OF ADVANTAGEOUS EMBODIMENTS OF THE INVENTION

It is an object of the present invention to provide a method for hardening workpieces which has a high productivity and in the case of which the above disadvantages are largely avoided.

This object is achieved by a method comprising the following steps:

(a) the workpieces are heated to a temperature of 950 to 1200° C., wherein 30 to 100% of the surface of each workpiece is heated with direct heat radiation of a heating device;

(b) the workpieces are subjected to a carbon-containing gas and/or a nitrogen-containing gas at a temperature of 950 to 1200° C. and a pressure of less than 100 mbar;

(c) the workpieces are held in an atmosphere at a pressure of less than 100 mbar at a temperature of 950 to 1200° C.;

(d) if appropriate, steps (b) and (c) are repeated once or several times; and (e) the workpieces are cooled.

The workpieces are heated in step (a) of the method according to the invention by arranging the workpieces alongside one another in one layer or row in the heating device. This type of arrangement is also denoted here and in the text which follows by the term "2D charge".

Further configurations of the method according to the invention are characterized in that:

in step (a), each of the workpieces is heated with heat radiation from two or more spatial directions;

in step (a), the zone near the surface of each of the workpieces is heated at a rate of 35 to 135° C.·min$^{-1}$, preferably 50 to 110° C.·min$^{-1}$ and in particular 50 to 75° C.·min$^{-1}$;

in step (a), the core of each of the workpieces is heated at a rate of 18 to 120° C.·min$^{-1}$;

in step (e), the workpieces are cooled in a temperature range of 800 to 500° C. at a specific cooling rate of 2 to 20 kJ·kg$^{-1}$·s$^{-1}$;

in step (b), the workpieces are subjected to acetylene ($C_2H_2$) and/or ammonia ($NH_3$);

in step (e), the workpieces are cooled with a gas, preferably with nitrogen;

the workpieces are cooled by means of nitrogen at a pressure of 2 to 20 bar, preferably 4 to 8 bar and in particular 5 to 7 bar;

in step (e), the surface of the workpieces is cooled from a temperature in the range of 900 to 1200° C. to a temperature of 300° C. within 40 to 100 s; and the cycle time for carrying out steps (a) to (e) based on one workpiece is 5 to 120 s, preferably 5 to 60 s and in particular 5 to 40 s.

To harden small workpieces or components such as injection nozzles for internal combustion engines or threaded bolts having a mass of 50 to 300 g according to the method according to the invention, approximately 50 to 400 components are arranged in the form of a bed with one to three layers in a rack formed as a basket or in a specially manufactured rack for the ordered positioning of the components. As a result of the large number of workpieces in the basket, it is possible to achieve a short cycle time in the range of 20 to 5 s for each workpiece for carrying out steps (a) to (e). The bulk density of the workpieces is chosen in this case in such a way that at least 30% of the surface of each workpiece is heated with direct heat radiation of a heating device.

In particular, the method according to the invention comprises the following steps:

(i) the workpieces are arranged in/on a rack in a single layer;

(ii) the rack with the workpieces is introduced into a cooling chamber, with evacuation to a pressure of less than 100 mbar;

(iii) the rack is transferred into a carburizing chamber, wherein the rack is temporarily stored in a parking receptacle, if appropriate, before being introduced into the carburizing chamber;

(iv) the workpieces are heated to a temperature of 950 to 1200° C. by means of heat radiation, wherein 30 to 100% of the surface of each workpiece is heated with direct heat radiation of the carburizing chamber;

(v) the workpieces are subjected to a carbon-containing gas and/or a nitrogen-containing gas at a temperature of 950 to 1200° C. and a pressure of less than 100 mbar;

(vi) the workpieces are held in an atmosphere at a pressure of less than 100 mbar at a temperature of 950 to 1200° C.;

(vii) if appropriate, steps (iv) and (v) are repeated once or several times;

(viii) the rack with the workpieces is transferred into the cooling chamber;

(ix) the workpieces are cooled with a gas, preferably with nitrogen; and (x) the rack with the workpieces is removed from the cooling chamber.

It is a further object of the invention to provide a device for hardening workpieces according to the above method.

This object is achieved by a device comprising two or more carburizing chambers, at least one cooling chamber and a transfer system for handling racks for the workpieces, wherein the cooling chamber can be connected to each of the carburizing chambers via one or more vacuum gate valves, and each carburizing chamber has a receptacle for a rack and at least two heating elements, which are arranged in such a manner that the radiation emitted thereby irradiates the surface of each of the workpieces at an average solid angle of 0.5 π to 2 π.

In an alternative embodiment, the device according to the invention comprises two or more carburizing chambers, at least one cooling chamber, a lock chamber arranged between the carburizing chambers and the cooling chamber, and a transfer system for handling racks for the workpieces, wherein the cooling chamber can be connected to the lock chamber via a vacuum gate valve, each of the carburizing chambers can be connected to the lock chamber via thermal insulation gate valves, and each of the carburizing chambers has a receptacle for a rack and at least two heating elements, which are arranged in such a manner that the radiation emitted thereby irradiates the surface of each of the workpieces at an average solid angle of 0.5 π to 2 π.

Developments of the device according to the invention are characterized in that:

- the thermal insulation gate valves are in the form of vacuum gate valves;
- the cooling chamber comprises two vacuum gate valves for introducing and removing workpieces;
- the heating elements are in the form of surface emitters;
- the heating elements consist of graphite or carbon-fiber-reinforced carbon (CFC);
- the racks are in the form of grid-like pallets;
- the racks consist of carbon-fiber-reinforced carbon (CFC); and
- the transfer system comprises vertically arranged chain drives with upper and lower guides and chains and also a horizontally movable telescopic fork for receiving pallets, wherein the telescopic fork is coupled to one of the chains via a gearing mechanism.

It is a further object of the invention to provide hardened workpieces having improved properties, in particular having reduced thermal distortion. On account of the reduced distortion, the expenditure for remachining (so-called hard machining) is reduced considerably.

This object is achieved by a workpiece made of a metallic material, which has been hardened according to one of the above-described methods.

The workpiece according to the invention is distinguished by the fact that:

- the case hardening depth (CHD) lies within a range of ±0.05 mm, preferably ±0.04 mm and in particular ±0.03 mm about a nominal value, wherein the nominal value is 0.3 to 1.4 mm;
- the surface carbon content lies within a range of ±0.025% by weight, preferably ±0.015% by weight and in particular ±0.01% by weight about a nominal value, wherein the nominal value is 0.6 to 0.85% by weight; and
- the core hardness lies within a range of ±30 HV, preferably ±20 HV about a nominal value, wherein the nominal value is 280 to 480 HV.

The deviation from the nominal value or the range of variation (i.e. the difference between the largest and smallest measured value) of the case hardening depth (CHD), of the surface carbon content and of the core hardness is determined by measurements on 1 to 5 workpieces in a charge.

The workpieces are primarily parts of machines and gearing mechanisms which are made of metallic materials, for example hollow wheels, gear wheels, shafts or injection components made of steel alloys such as 28Cr4 (in accordance with ASTM 5130), 16MnCr5, 18CrNi8 and 18CrNiMo7-6.

BRIEF DESCRIPTION OF THE FIGURES

The invention is explained in more detail hereinbelow with reference to figures, where.

DETAILED DESCRIPTION OF ADVANTAGEOUS EMBODIMENTS OF THE INVENTION

Figure 1A:
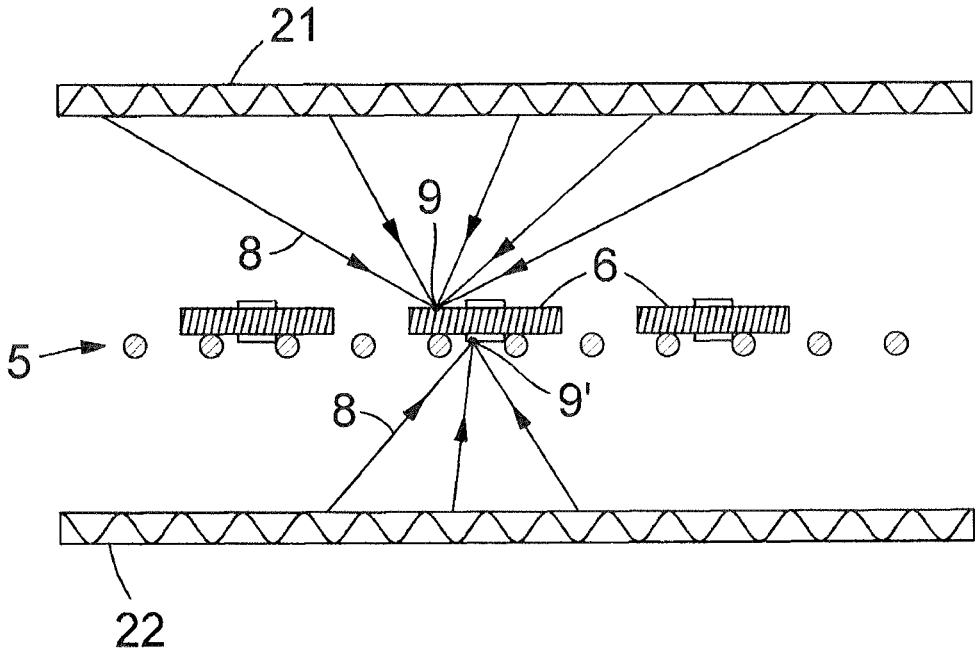
FIG. 1*a* shows an arrangement of a workpiece with two heating elements.
Figure 1B:
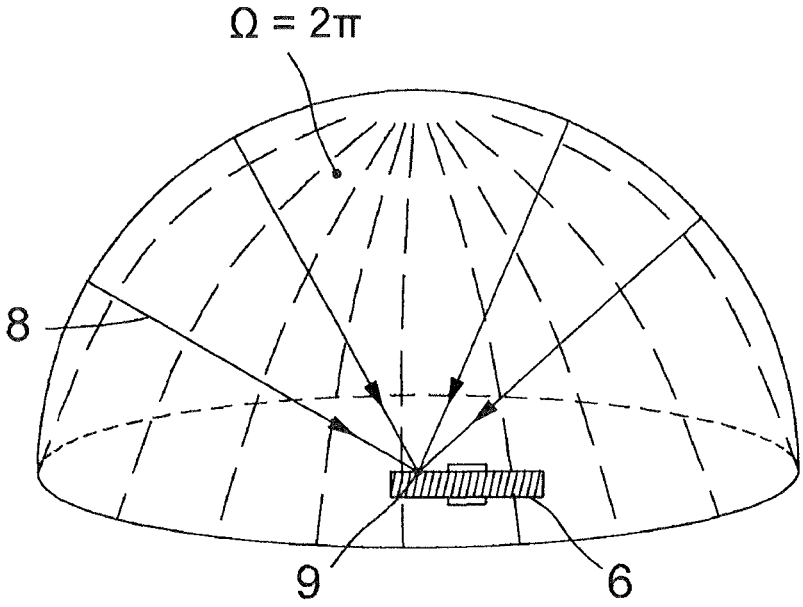
FIG. 1*b* shows the radiant heating of a workpiece.

FIG. 1*a* shows an arrangement for heating workpieces 6 having two heating elements (21, 22). The workpieces 6 are stored on a rack 5 in the form of a grid-like pallet. The heating elements (21, 22) are arranged in such a manner in relation to the pallet 5 or to the workpieces 6 that the radiation emitted by the heating elements (21, 22), which is denoted by arrow lines 8 in FIG. 1, is incident on the surface of the workpieces 6 from various spatial directions. It is preferable for the heating elements (21, 22) to be arranged on both sides of the pallet 5 and such that they lie opposite one another. The arrangement of the heating elements (21, 22) is selected in such a way that 30 to 100% of the surface of each workpiece 6 is exposed to direct heat radiation 8, i.e. is in direct visual contact with the surface of the heating elements (21, 22). In an expedient development of the invention, the heating elements (21, 22) are formed and arranged in relation to the workpieces 6 in such a manner that the solid angle illuminated on average by the heat radiation 8 incident on a point (9, 9') of the surface of a workpiece 6 is 0.5 π to 2 π. This configuration, in which 30 to 100% of the surface of each workpiece 6 is illuminated with heat radiation 8 at an average solid angle of 0.5 π to 2 π, makes it possible to rapidly heat the workpieces 6. FIG. 1*b* is a perspective view showing a maximum solid angle Ω of the magnitude 2 π for the irradiation of a point 9 on the surface of a workpiece 6. It can be seen from FIG. 1*a* that partial regions of the surface of the workpieces 6 are obscured by the pallet 5 and have no direct visual contact with the heating elements (21, 22). The same applies to regions in which the surface of the workpieces 6 has a concave form. The above-mentioned surface regions are heated indirectly by heat conduction within the workpieces 6. If, according to the invention, at least 30% of the surface of each workpiece is in direct visual contact with one of the heating elements (21, 22), rapid heating of the workpieces 6 is ensured.

The heating elements (21, 22) are preferably "active radiant heaters" which are operated with electric power. However, the invention also includes "passive radiant heaters", for example the wall of a carburizing chamber which has been heated to a high temperature of more than 1000° C., in particular of more than 1400° C., by means of a radiant heater arranged in the carburizing chamber. The walls of the carburizing chamber preferably have a heat capacity which is several times the heat capacity of the workpieces to be hardened. This ensures that the temperature of the carburizing chamber drops only slightly during the loading and removal of the workpieces. The effects according to the invention are achieved in the same way with electric radiant heaters as with walls of a carburizing chamber which have been heated by a radiant heater.

Figure 2:
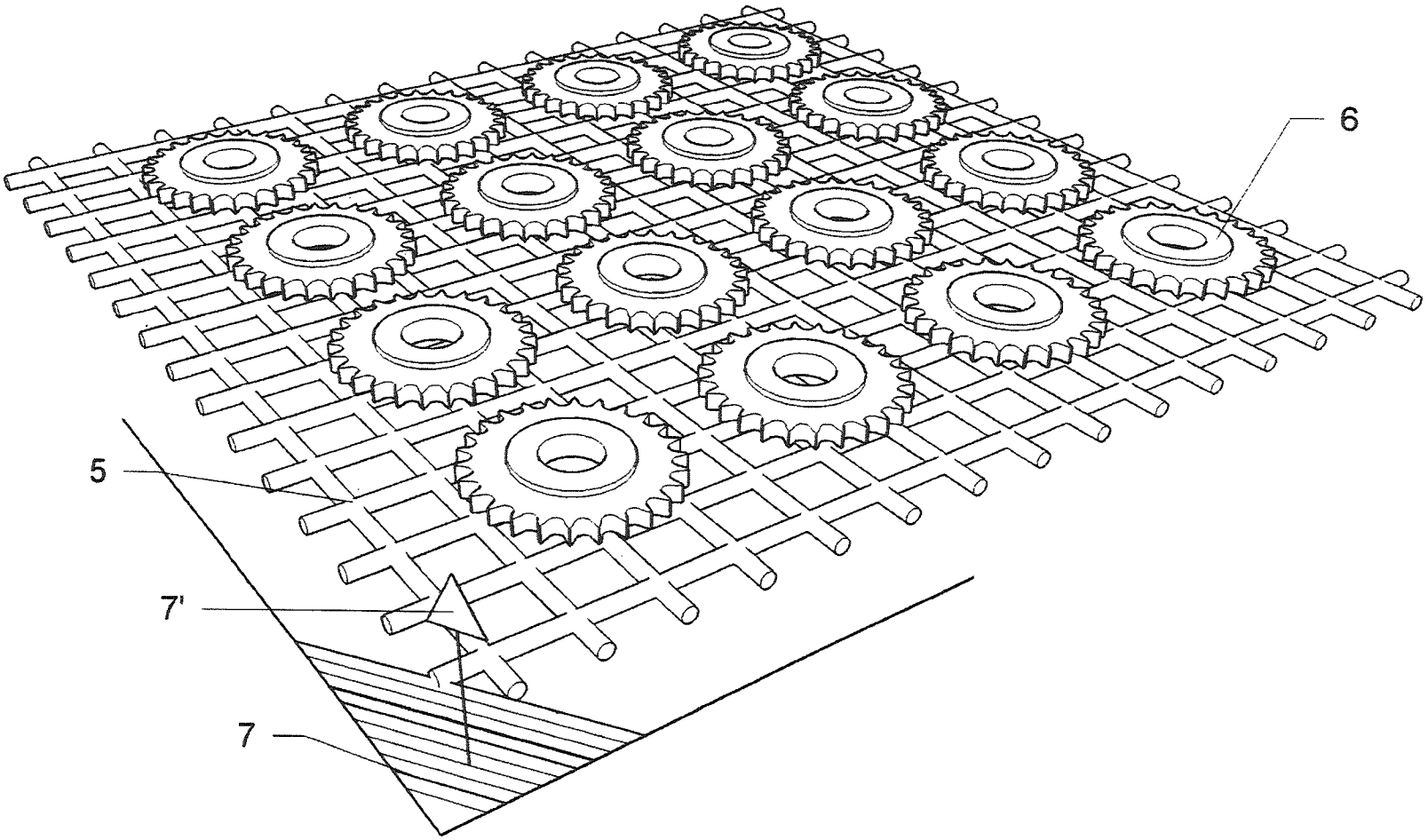
FIG. 2 shows a pallet with workpieces.

FIG. 2 is a perspective view showing a single-layer arrangement according to the invention of workpieces 6, which are for example gear wheels, on a grid-like pallet 5. The ratio of open area to grid, measured in the transverse plane of symmetry 7 of the pallet 5 and with respect to a surface normal 7' perpendicular to the transverse plane of symmetry 7, is referred to here and in the text which follows as opening ratio, and according to the invention is greater than 60%, preferably greater than 70% and in particular greater than 80%. Expediently, the pallet 5 consists of carbon-fiber-reinforced carbon (CFC), and therefore it has a high mechanical and thermal stability.

Figure 3:
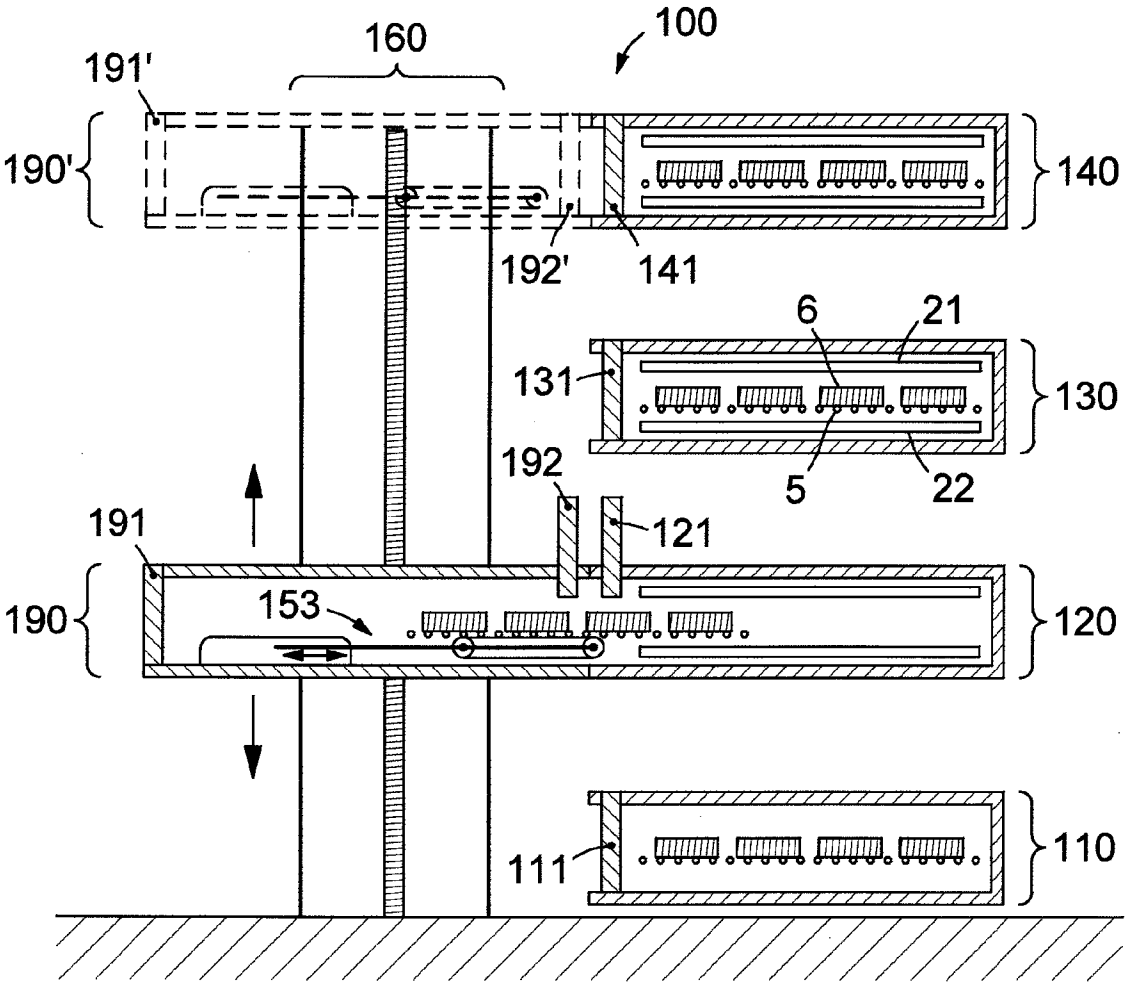
FIG. 3 shows a hardening device having a vertically movable cooling chamber.

A device 100 according to the invention, shown schematically in FIG. 3, comprises a vertically movable cooling chamber 190 and four carburizing chambers (110, 120, 130, 140) arranged vertically one above another. The cooling chamber 190 and each of the carburizing chambers (110, 120, 130, 140) is connected to a vacuum pump or to a vacuum pump stand (not shown in FIG. 3). By means of the vacuum pumps, each of the chambers (190; 110, 120, 130, 140) can be evacuated to a pressure of less than 100 mbar, preferably of less than 20 mbar, independently of the other chambers.

The cooling chamber 190 is additionally connected to a pressure vessel (not shown in FIG. 3) for a cooling gas, such as helium or nitrogen, via a gas line. The cooling gas is held in the pressure vessel at a pressure of 2 to 25 bar. To generate pressure, the pressure vessel is connected. in a known manner to a compressor or a high-pressure gas supply. The gas line from the pressure vessel to the cooling chamber 190 is equipped with an adjustable valve. To aerate or evacuate the cooling chamber 190, the adjustable valve is moved into the closed position, such that no cooling gas passes from the pressure vessel into the cooling chamber 190.

Each of the carburizing chambers (110, 120, 130, 140) is connected to a vessel (not shown in FIG. 3) for a carbon-containing gas, such as acetylene, via a dedicated gas line. Optionally, each of the carburizing chambers is connected to a further vessel for a nitrogen-containing gas. The gas lines from the vessel(s) to the carburizing chambers (110, 120, 130, 140) are equipped with adjustable valves, preferably with mass flow controllers (MFC), in order to precisely control the gas flow supplied to the respective carburizing chamber (110, 120, 130, 140).

Furthermore, each of the carburizing chambers (110, 120, 130, 140) comprises two heating elements (21, 22) and also a receptacle or holder—not shown in FIG. 3—for a pallet 5. The heating elements (21, 22) are operated electrically, preferably have an extensive form and consist of a material such as graphite or carbon-fiber-reinforced carbon (CFC). In particular, the heating elements (21, 22) are in the form of meandering large-area heaters (see FIG. 6).

The cooling chamber 190 is equipped at two opposing ends with a first and second vacuum gate valve 191 and 192. When the vacuum gate valves 191 and/or 192 are open, a pallet 5 with workpieces 6 can be introduced into or removed from the cooling chamber 190. For transferring or for handling the pallet 5, the cooling chamber 190 is equipped with a transfer system 153 which is automated, in particular coupled to a programmable logic controller (PLC). The cooling chamber 190 is mounted on a support of a vertical lifting device 160. By means of the lifting device 160, the cooling chamber 190 can be positioned in front of each of the carburizing chambers (110, 120, 130, 140). Each of the carburizing chambers (110, 120, 130, 140) is equipped with a vacuum gate valve (111, 121, 131, 141). The cooling chamber 190 and the carburizing chambers (110, 120, 130, 140) are designed in such a manner that they can be connected to one another in a vacuum-tight manner, when the cooling chamber 190 is positioned in front of one of the carburizing chambers (110, 120, 130, 140). Vacuum components (not shown in FIG. 3) which are suitable for such a coupling are known to a person skilled in the art and commercially available. FIG. 3 shows by way of example the vacuum-tight coupling between the cooling chamber 190 and the carburizing chamber 120. In this case, the vacuum gate valves 192 and 121 of the cooling chamber 190 and of the carburizing chamber 120 can be opened at the same time, without the vacuum in one of the chambers being broken. The configuration of the chambers (190; 110, 120, 130, 140) with vacuum technology according to the invention therefore makes it possible to transfer a pallet 5 with workpieces 6 back and forth between one of the carburizing chambers (110, 120, 130, 140) and the cooling chamber 190, without breaking the vacuum.

Figure 3A:
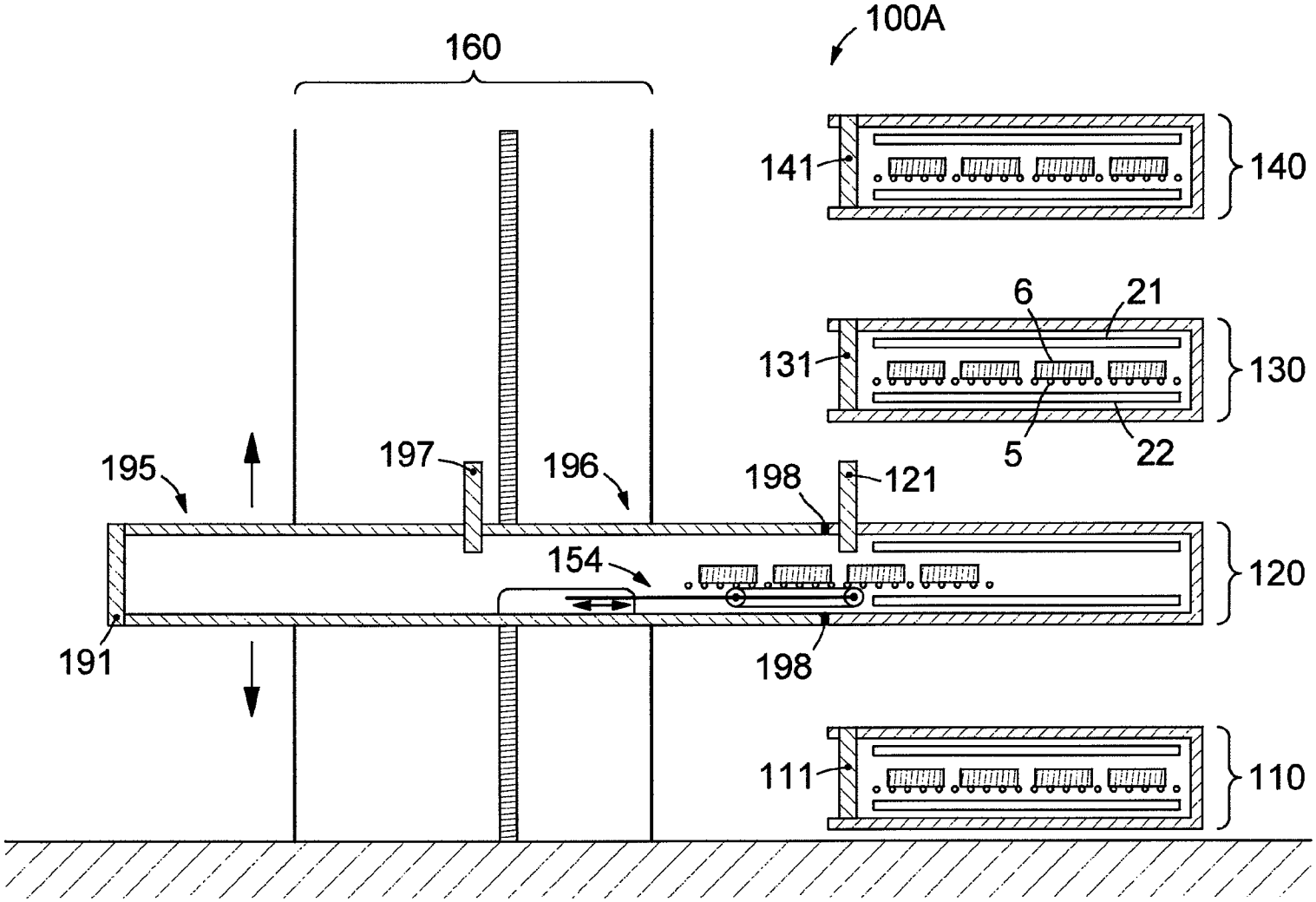
FIG. 3A shows a device having a transfer chamber.

FIG. 3A shows an advantageous embodiment 100A of the device according to the invention, comprising a cooling chamber 195 and a transfer chamber 196. The transfer chamber 196 is mounted on that side of the cooling chamber 195 which faces the carburizing chambers (110, 120, 130, 140), and serves to receive a horizontal transfer system 154. On account of its arrangement in the transfer chamber 196, the transfer system 154 is available, irrespective of the operating state of the cooling chamber 195, to load one of the carburizing chambers (110, 120, 130, 140) with a pallet 5 with workpieces 6. The transfer system 154 is horizontally movable in both directions, and therefore the pallet 5 can be transferred between the cooling chamber 195 and each of the carburizing chambers (110, 120, 130, 140). A repository (not shown in FIG. 3A) for parking a pallet with "fresh" workpieces 6, i.e. workpieces 6 to be hardened, is additionally provided in the device 100A on the topmost carburizing chamber 140. For vacuum-tight separation, a vacuum gate valve 197 is arranged between the cooling chamber 195 and the transfer chamber 196. At an end facing the carburizing chambers (110, 120, 130, 140), the transfer chamber 196 has an opening, the edge of which can be connected in a vacuum-tight manner to the carburizing chambers (110, 120, 130, 140). To this end, the edge of the opening is equipped with a circumferential vacuum seal 198. The vacuum seal 198, which consists for example of rubber, serves to dock the transfer chamber 196 onto one of the carburizing chambers (110, 120, 130, 140). The transfer chamber 196, as well as the cooling chamber 195 and each of the carburizing chambers (110, 120, 130, 140), is connected to a dedicated vacuum pump (not shown in FIG. 3A) or to a vacuum pump stand. Accordingly, the transfer chamber 196 can be used as a vacuum lock between the cooling chamber 195 and the carburizing chambers (110, 120, 130, 140). By means of the lifting device 160, the transfer chamber 196 can be moved together with the cooling chamber 195 in the vertical direction and positioned in front of each of the carburizing chambers (110, 120, 130, 140). For docking onto the carburizing chambers (110, 120, 130, 140), the transfer chamber 196 and the cooling chamber 195 are mounted on a horizontally arranged linear drive mechanism (not shown in FIG. 3A). The horizontal linear drive mechanism is mounted for its part on a support of the vertical lifting device 160. The above-described embodiment 100A comprising a transfer chamber 196 corresponds to the concept of an installation of the ModulTherm type from ALD Vacuum Technologies AG.

Each of the carburizing chambers (110, 120, 130, 140) is electrically heatable. The heating is preferably effected by two electrically operated heating elements (21, 22) which have an extensive form and are arranged so as to lie opposite one another in each case on the bottom side and top side of each of the carburizing chambers (110, 120, 130, 140). The walls of the carburizing chambers (110, 120, 130, 140) consist of a metallic material, in particular of steel, and if appropriate have a double-walled form and are equipped with lines for a cooling fluid, such as water. That side of the walls of the carburizing chambers (110, 120, 130, 140) which faces the interior of the chamber is lined with a thermally insulating material, such as graphite felt (not shown in FIG. 3). In a particularly preferred embodiment of the invention, the walls of the carburizing chambers (110, 120, 130, 140) are additionally equipped on the inner side with a heat-storing material, such as steel or graphite. By suitably choosing the thickness or mass ratio of the heat-storing material in relation to the thermally insulating material (for example mass occupancy (kg/m$^2$) graphite in relation to mass occupancy (kg/m$^2$) graphite felt), the heat capacity and the thermal power loss of the carburizing chambers (110, 120, 130, 140) can be adapted to specified values. It is thereby possible to reduce the drop in temperature during the introduction and during the removal of workpieces 6 into/from the carburizing chambers (110, 120, 130, 140) by using thick graphite plates having a high heat capacity. This makes it possible to shorten the heating time and to increase the throughput or the productivity of the device. A carburizing chamber (110, 120, 130, 140) which is equipped in such a way with a heat-storing inner lining can be operated in the manner of a thermal cavity radiator, wherein the "power loss" radiated to workpieces 6 and/or into the environment is fed in by means of an electrical heater, which is arranged at any desired location in the carburizing chamber (110, 120, 130, 140). In this embodiment, the workpieces 6 are heated by the radiation emitted by the "passive" inner lining of the carburizing chambers (110, 120, 130, 140).

Figure 4:
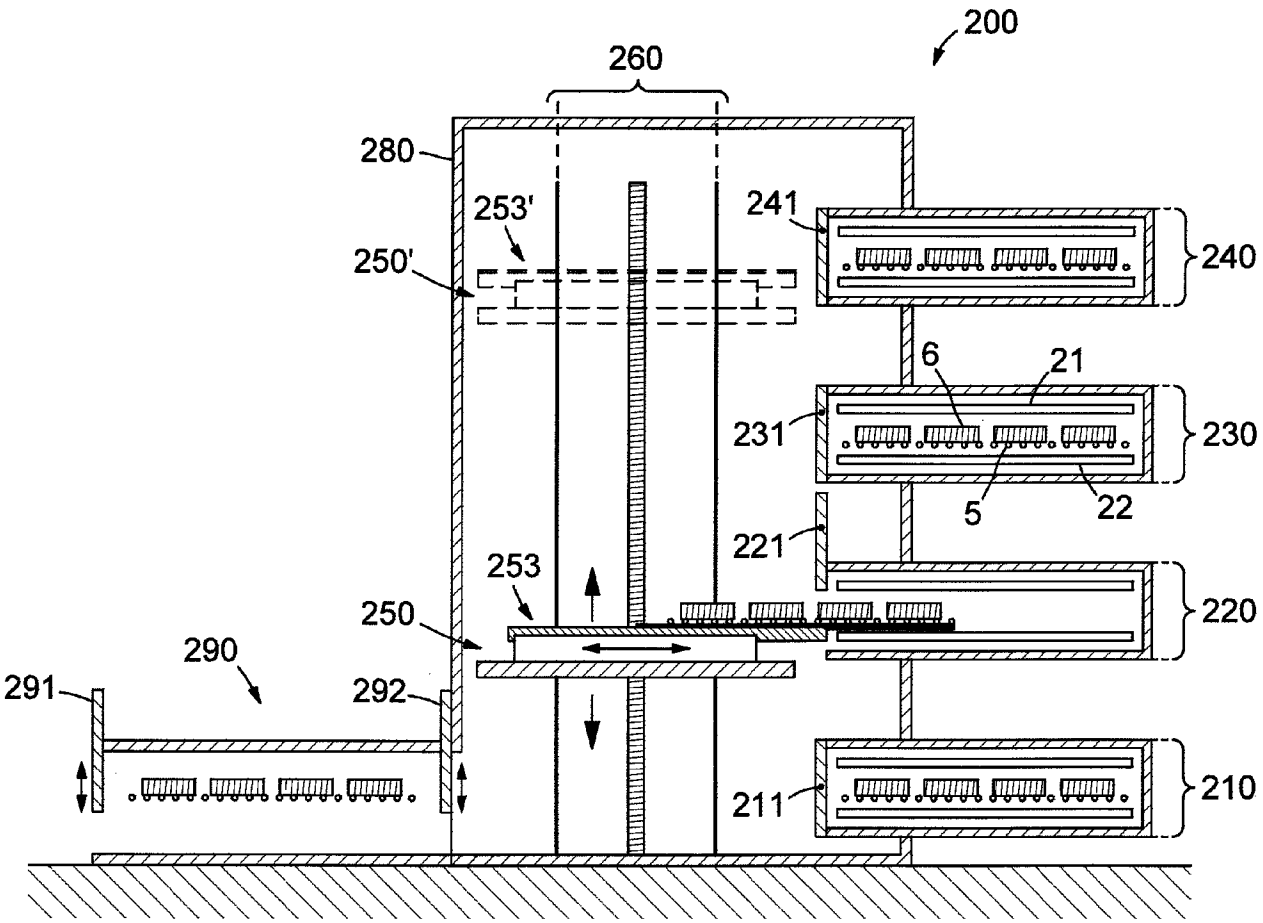
FIG. 4 shows a hardening device having a stationary cooling chamber and a central lock chamber.

FIG. 4 shows a particularly preferred device 200 comprising a stationary cooling chamber 290, which is connected via a lock chamber 280 to four carburizing chambers (210, 220, 230, 240) arranged vertically one above another. The cooling chamber 290 is equipped with a first and second lock 291 and 292 for introducing and removing a pallet 5 with workpieces 6. A lifting device 260 with a vertically movable support 250 is provided in the lock chamber 290. An automated transfer system 253 which is movable horizontally in both directions is mounted on the support 250. The vertical lifting device 260 in conjunction with the transfer system 253 serves to transfer a pallet 5 with workpieces 6 between the cooling chamber 290 and the carburizing chambers (210, 220, 230, 240).

The lock chamber 280 and the cooling chamber 290 are connected to vacuum pumps or a vacuum pump stand—not shown in FIG. 4—and can be evacuated to a pressure of less than 100 mbar independently of one another. Optionally, each of the carburizing chambers (210, 220, 230, 240) is additionally connected to a vacuum pump or to the vacuum pump stand and can be evacuated independently of the other chambers. Analogously to the device 100 shown in FIG. 3, the cooling chamber 290 is connected to a pressure vessel for a cooling gas, for example helium or nitrogen, and each of the carburizing chambers (210, 220, 230, 240) is connected to a vessel for a carbon-containing gas, such as acetylene, and/or a vessel for a nitrogen-containing gas.

Each of the carburizing chambers (210, 220, 230, 240) is equipped with movable gate valves (211, 221, 231, 241), which primarily serve for the thermal confinement and for the storage of heat energy in the carburizing chambers (210, 220, 230, 240). The thermal insulation gate valves (211, 221, 231, 241) are opened merely for introducing and removing workpieces into/from the carburizing chambers (210, 220, 230, 240). Optionally, the thermal insulation gate valves (211, 221, 231, 241) can be in the form of vacuum gate valves, such that the carburizing chambers (210, 220, 230, 240) can be closed in a vacuum-tight manner with respect to the lock chamber 280.

Analogously to the device 100 shown in FIG. 3, the carburizing chambers (210, 220, 230, 240) of the device 200 are equipped with a multilayer lining of a heat-storing material, such as graphite, and a thermally insulating material, such as graphite felt.

In an expedient development of the device 200, the lock chamber 280 comprises a receptacle for a pallet 5, which makes it possible to "park" the pallet 5 with workpieces 6, in order to keep it ready for loading one of the carburizing chambers (210, 220, 230, 240) as soon as the latter has been unloaded and released. This "parking receptacle" is preferably arranged vertically above the carburizing chambers (210, 220, 230, 240). By means of the parking receptacle, the cycle time for carburizing a pallet can be reduced, and therefore the throughput or the productivity which can be achieved with the device 200 can be increased.

The devices 100 and 200 shown in FIGS. 3 and 4 have a modular design, and therefore it is possible to add further carburizing chambers in order to increase the productivity. Depending on the duration of the individual method steps listed below:

- introduction of the pallet into the cooling chamber,
- pumping out of the cooling chamber,
- transfer into an empty carburizing chamber, optionally with temporary storage in a parking receptacle,
- carburization and diffusion,
- transfer into the cooling chamber,
- cooling,
- removal of the pallet from the cooling chamber, it may prove to be expedient to use 6 carburizing chambers instead of 4, as shown in FIGS. 3 and 4. If the production capacity which is required is low, it is possible on the other hand to use only 2 or 3 carburizing chambers, in order to reduce the initial investment costs.

Figure 5B:
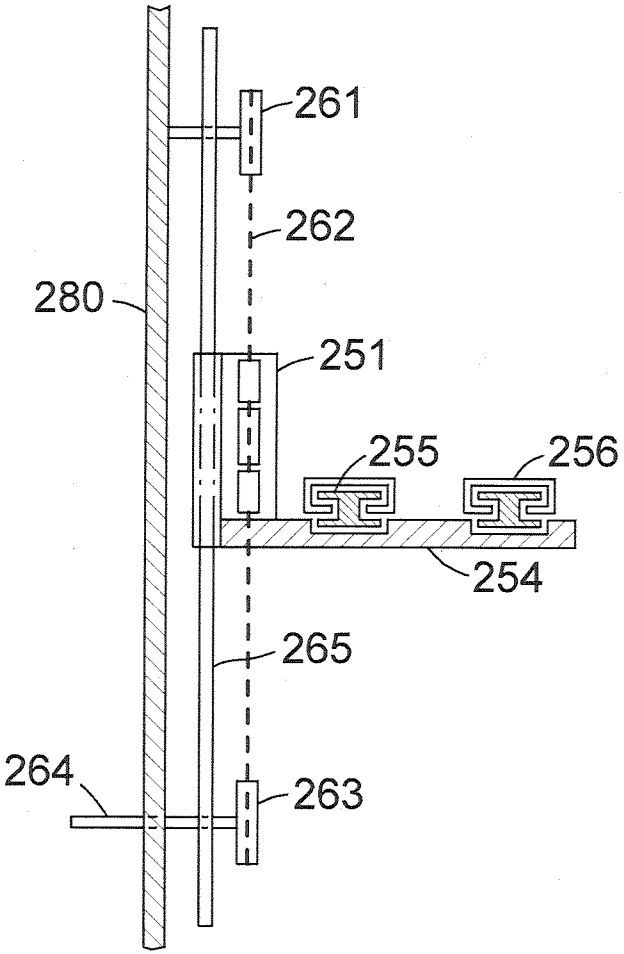
FIGS. 5A-B show a transfer system for a device having a central lock chamber.
Figure 5A:
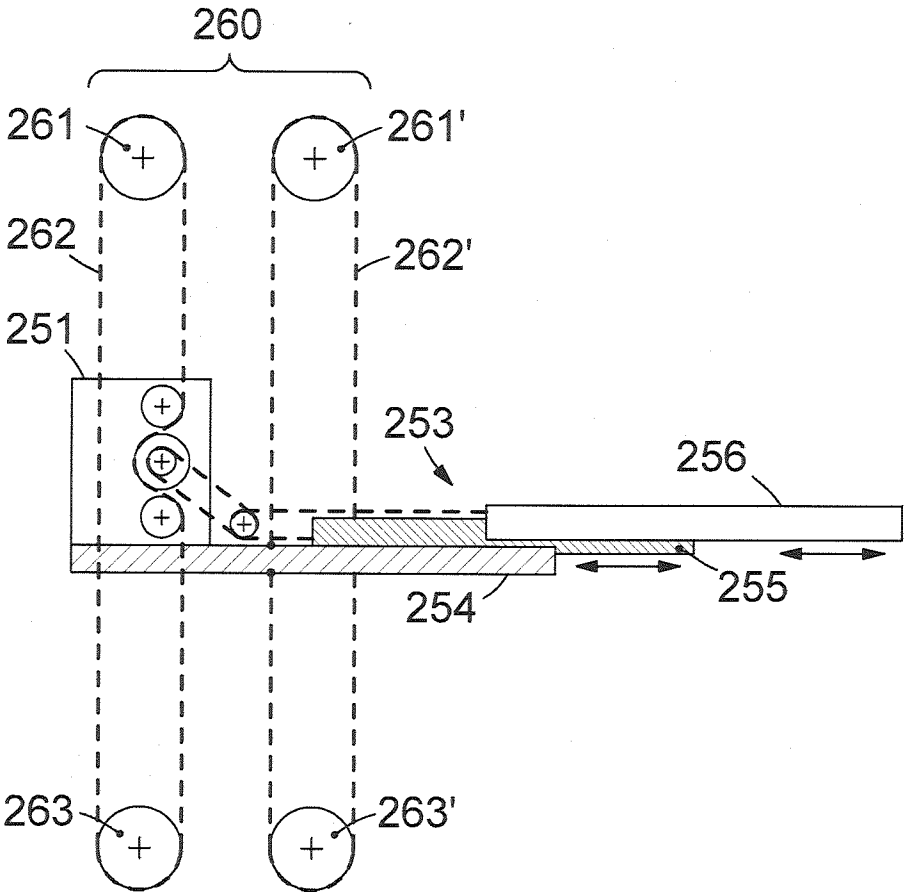

FIGS. 5A-5B show a schematic front view and side view of a transfer device (260, 253) which is preferred according to the invention for the device 200 comprising a lock chamber 280 as portrayed in FIG. 4.

The transfer system (260, 253) comprises two vertically arranged chain drives with upper and lower guides (261, 263; 261', 263') and chains (262; 262'). The chain 262' is connected to a horizontal platform 254. The platform 254 is guided on one or two vertical bearings 265. A horizontally movable telescopic fork (255, 256) for receiving pallets 5 is mounted on the platform 254. The telescopic fork (255, 256) is driven via a gearing mechanism 251, which is coupled to the chain 262. The coupling between the chain 262 and the gearing mechanism 251 is effected by a plurality of guides.

The guides 263 and 263', which are preferably gear wheels, are coupled via shafts 264 to motors (not shown in FIGS. 5A-5B) arranged outside the lock chamber 280. To feed through the shafts 264, the wall of the lock chamber 280 is equipped with vacuum-tight rotary leadthroughs. To move the platform 254 vertically, the chain drives (261, 262, 263) and (261', 262', 263') are activated synchronously, such that the setting between the chain 262 and the gearing mechanism 251 remains unchanged and the telescopic fork (255, 256) retains its horizontal position. This prevents collisions between the telescopic fork (255, 256) and other parts of the device 200, such as the carburizing chambers. The telescopic fork (255, 256) is moved horizontally, if the platform 254 is at fixed vertical positions, in that the chain 262 is activated via the gear wheel 263 and the shaft 264 by a motor arranged outside the lock chamber 280.

Figure 6:
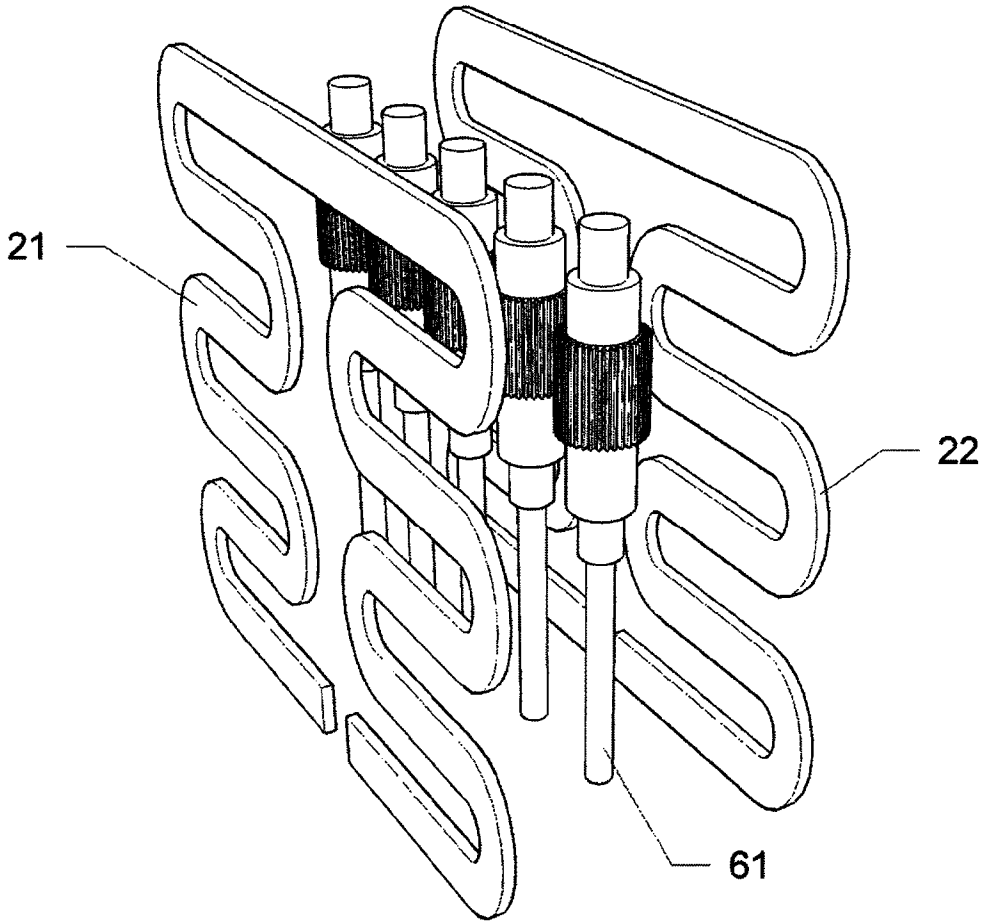
FIG. 6 shows a plurality of workpieces between two heating elements in a vertical arrangement.

FIG. 6 shows a perspective partial view of a further embodiment of the invention, in which workpieces 61, for example gear shafts, are arranged in a vertical layer or row between heating elements 21 and 22 in a carburizing chamber. The workpieces 61 are held in their position by means of a rack (not shown in FIG. 6). In this case, the rack is in the form of a frame with suspension brackets or in the form of a support plate with mechanical holding devices, such as spikes for racking or bores for pushing in shafts. A device according to the invention for hardening workpieces in a vertical arrangement according to FIG. 6 is designed analogously to the devices shown in FIGS. 3 and 4, and differs therefrom merely in that the carburizing chambers are arranged alongside one another in a horizontal direction rather than vertically one above another. In accordance with this, the cooling chamber is arranged so as to be horizontally movable and the lock chamber and the transfer device are arranged horizontally. The invention encompasses both the horizontal mounting of workpieces (for example on a pallet), as shown in FIGS. 3 and 4, and the vertical mounting or suspension, as shown in FIG. 6. Both of these embodiments have the common feature, which is essential to the invention, that the workpieces are arranged in one layer or one row, i.e. in the manner of a 2D charge, in the heating device, such that 30 to 100% of the surface of each workpiece is directly exposed to the heat radiation emitted by the heating device.

The heating elements (21, 22) shown in FIG. 6 are in the form of meandering large-area heaters made of graphite or CFC. Large-area heaters (21, 22) of this type are known in the prior art and are commercially available from various manufacturers.

In a development of the invention, the cooling chamber is equipped with a mechanical fixture device and/or a flow guiding apparatus for the cooling gas. The fixture device is adapted to the geometry of the workpieces and is arranged in this case according to the invention in the cooling chamber above the workpieces to be cooled. Before the start of gas admission, either the pallet with the workpieces is pressed from below against the fixture device with a defined force, or the fixture device is pressed from above onto the workpieces with a defined force before the start of gas admission. With the aid of the fixture device, the planarity of the workpieces following cooling is improved considerably, and therefore the distortion of the workpieces is reduced considerably.

In addition, the cooling chamber can be equipped with a flow guiding apparatus for cooling the workpieces with low distortion. In this case, this guiding apparatus is arranged in the cooling chamber above the workpieces to be cooled, and is formed in such a manner that gas is incident on the components at a high local velocity, and in addition the cooling is effected very uniformly. In order to bring about the most uniform cooling possible, in this case component segments having a large wall thickness are subjected to a high flow velocity, and component segments having a small wall thickness are subjected to a low flow velocity. Furthermore, it is possible to design the guiding apparatus "three-dimensionally", such that the workpieces are systematically subjected to cooling gas both from above and from the side. To this end, before the start of gas admission, either the workpieces have to be raised from below into the guiding apparatus, or the guiding apparatus has to be lowered from above onto the workpieces.

With the aid of the flow guiding apparatus, the cooling rate of the workpieces is increased considerably. This makes it possible to harden workpieces which are made of less well-alloyed materials. In addition, the gas consumption costs are reduced, since quenching can be carried out at lower gas pressures. Furthermore, the distortion of the workpieces is reduced considerably, since the cooling is effected more uniformly and therefore less stress is created in the workpiece.

Only on account of the single-layer heat treatment according to the invention (2D charging) is it possible to use the fixture device and/or the flow guiding apparatus. In the prior art with multilayer 3D charging, it is not possible to use these options.

Methods for Measuring the Temperature and Carbon Content

A person skilled in the art is familiar with methods for measuring the temperature of metallic workpieces. Within the context of the present invention, the temperature of the workpiece surface was measured by means of thermocouples, pyrometers and thermal imaging cameras. Each of the thermocouples was fastened to the workpieces by wiring, in such a manner that the entire sensor area of the thermocouple was in contact with the workpiece surface. In order to make good contact possible between the sensor and the workpiece, a small groove is made in the component surface. The thermocouple and also the fastening wire have a negligible heat capacity compared to the workpiece.

The temperature in the core of the workpieces was likewise measured by means of thermocouples. To this end, a blind hole having a diameter of 0.5 to 1.5 mm was drilled at that location of the workpiece which was to be measured, and the thermocouple was inserted into the blind hole. The temperature in the core of the workpieces is used to determine the specific cooling rate in units of [$kJ \cdot kg^{-1} \cdot s^{-1}$]. To this end, the product of the measured temperature T and of the specific heat capacity C (unit $kJ \cdot kg^{-1} \cdot K^{-1}$) of the workpiece in the range of 800 to 500° C. is integrated, according to the relationship $Q=\int C(T)dT$, and divided by the time required for cooling. In the case of steel, the specific heat capacity at a temperature of 800° C. is about 0.8 $kJ \cdot kg^{-1} \cdot K^{-1}$, and increases to a multiple of this value in a narrow temperature range around 735° C.

The signals from the thermocouples were recorded by means of a mobile, thermally insulated electronic measured value detector ("Furnace Tracker"), which was introduced together with the workpieces into the hardening device, i.e. both into the cooling chamber and into the carburizing chambers.

The thermocouples were used to determine the temperature profile during the heating of the workpieces in the carburizing chambers and also during the cooling in the cooling chamber.

To determine the surface carbon content, the workpiece surface was abraded at a shallow angle of 10° down to a depth of about 1000 μm, and the abraded surface, following careful cleaning, was measured by means of optical spectral analysis, secondary ion mass spectrometry (SIMS), and also electron probe micro analysis (EPMA), with a lateral resolution of less than 10 μm, i.e. a depth resolution of less than 3.5 μm (=10 μm×sin(10°)). The chemical detection limit achieved by means of SIMS for carbon is in the region of less than 1 ppm.

EXAMPLES

Example 1

Sun gears made of the material 20MoCr4 and having an outer diameter of 54 mm, an inner diameter of 30 mm and a height of 35 mm were used to compile a 2D charge according to the invention, with one layer of 5 rows each with 8 pieces, i.e. 40 pieces with an overall weight of 12.5 kg, and a 3D charge, with 8 layers each with 5 rows each with 8 pieces, i.e. 320 pieces with an overall weight of 100 kg. As the charging rack for one layer, structurally identical mesh grids made of CFC and having the dimensions 450 mm×600 mm were used both for the 2D charge and for the 3D charge.

For the result of the hardening processes, the following target values were predefined:

- case hardening depth 0.3 to 0.5 mm with a limit hardness of 610 HV;
- surface hardness of 670 HV on the end face; and
- core hardness of greater than 280 HV10 in the center of the tooth in the root circle.

Figure 7:
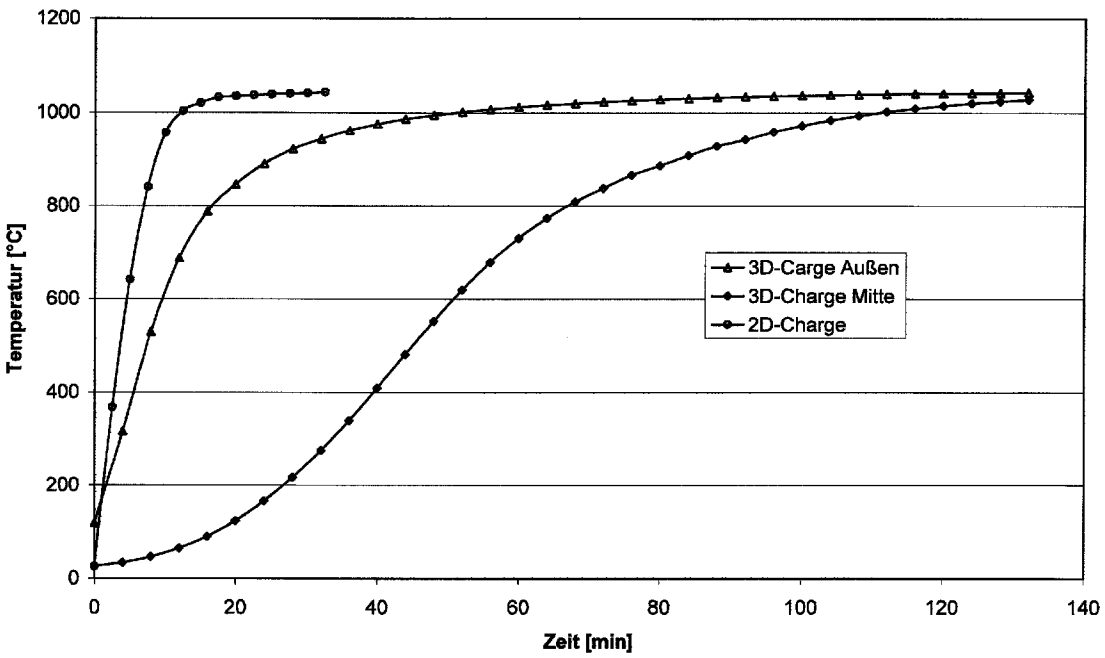
FIG. 7 shows measured data relating to the heating of workpieces.

FIG. 7 shows a comparison of the temperature profile of workpieces which were hardened according to the invention (2D charge, single-layer) and conventionally (3D charge, multilayer). The temperature is measured in both cases by means of a plurality of thermocouples, which were fitted to workpieces that were positioned in the center and at the edge of the respective charge. The data measured by the thermocouples was recorded by means of a Furnace Tracker. In the case of the 2D charge according to the invention, the temperature rises quickly, with no difference in the temperature profile being discernible between a workpiece positioned in the center of the charge and a workpiece positioned at the edge of the charge. By contrast, in the case of the 3D charge the temperature profile of a workpiece positioned in the center of the charge differs considerably from the temperature profile of a workpiece positioned at the edge of the charge. In addition, the temperature of the workpieces in the 2D charge rises more rapidly than that of the workpieces at the edge of the 3D charge. This difference is a result of the radiation energy which workpieces lying on the outside of the 3D charge give off or lose to workpieces lying on the inside. In order to heat all workpieces in the 3D charge, in particular the workpieces lying on the inside, to a temperature of 1050° C., a time of about 130 min is required. By contrast, the heating in the case of the 2D charge takes about 15 min.

Figure 8:
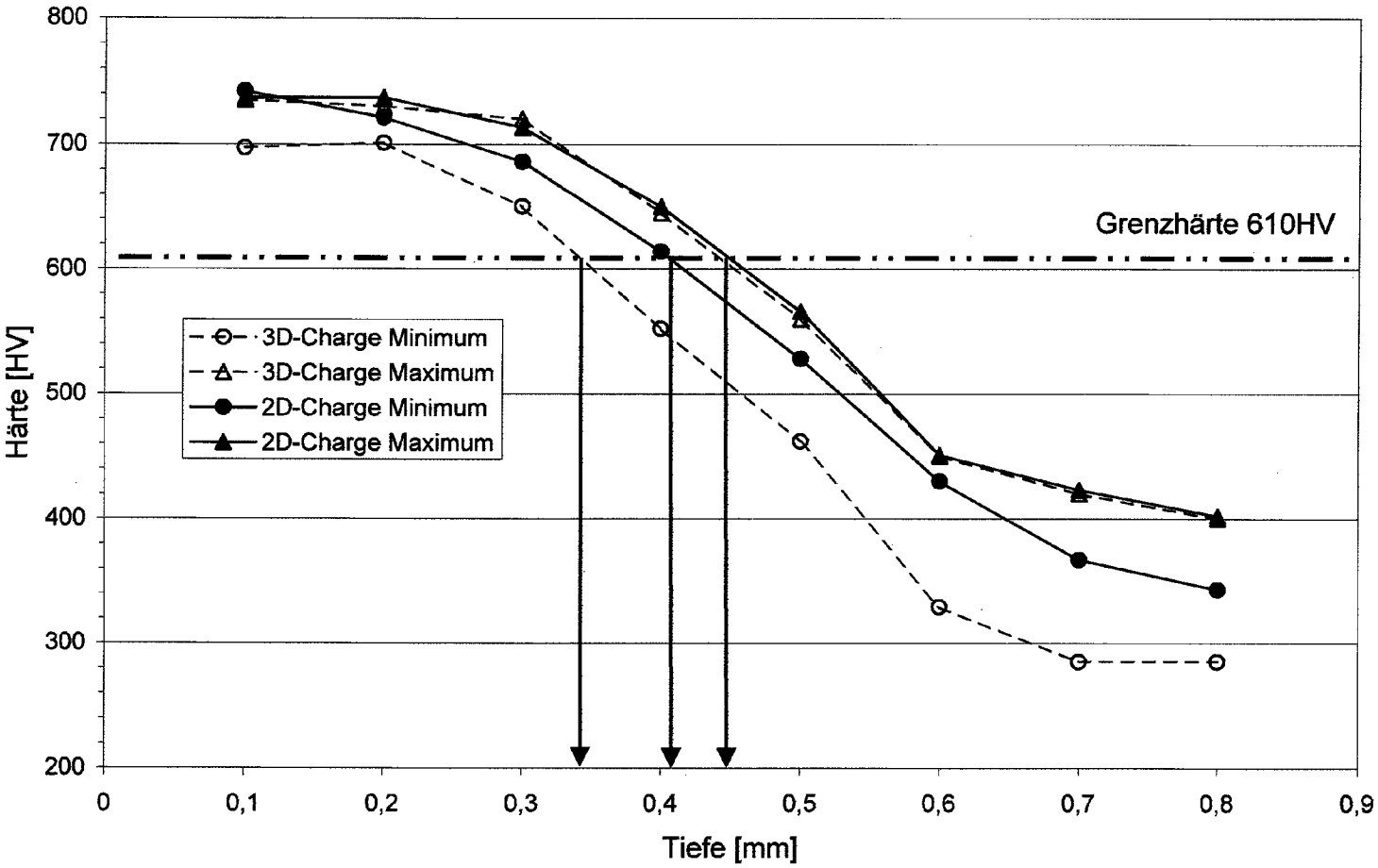
FIG. 8 shows measured data relating to the hardness profile of workpieces.

FIG. 8 shows the profile of the hardness as a function of the distance from the surface of the workpieces. With reference to the measurement curves, it is possible to see the case hardening depth (CHD). The CHD is determined in accordance with DIN ISO 2639 (2002). To this end, the component to be tested is severed perpendicular to the surface, avoiding the evolution of heat. At an increasing distance from the surface, the Vickers hardness HV1 is then measured—generally with a test load of 9.8 N. The distance from the surface to the point at which the hardness corresponds to the limit hardness (Hs, in this case 610 HV1) is referred to as the CHD.

It can be gathered from FIG. 8 that the variation (difference between the greatest and smallest measured values) of the CHD values is significantly smaller in the 2D charge, at about 0.06 mm, than that of the 3D charge, at about 0.12 mm.

Figure 9:
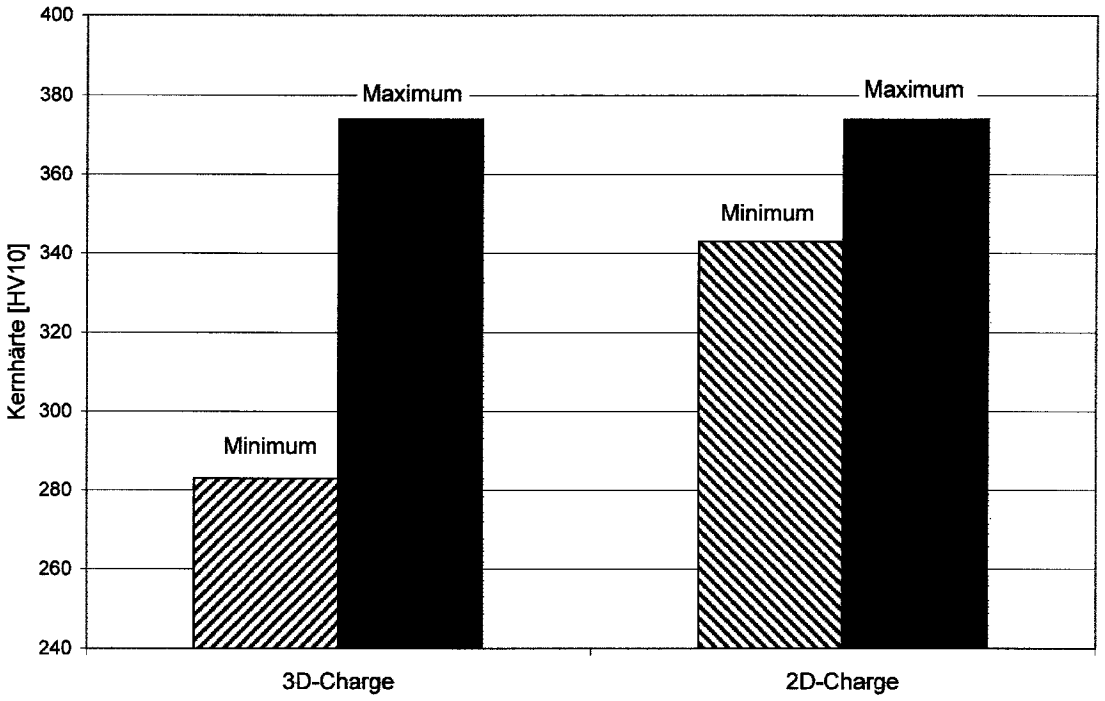
FIG. 9 shows measured data relating to the core hardness of workpieces.

FIG. 9 shows a comparison of the measured values for the core hardness. To determine the core hardness, a hardened workpiece (here the sun gears described above) is severed perpendicular to its axis of symmetry, avoiding the evolution of heat. The severed surface is ground and polished. Then, the Vickers hardness [HV10] is determined in the core of the tooth root (=center between tooth fillets). This measurement is made in accordance with DIN EN ISO 6507-1 (Metallic materials—Vickers hardness test—Part 1: Test method ISO 6507-1: 2005; German version EN ISO 6507-1: 2005). It can be seen from FIG. 9 that the variation in the core hardness in the 2D charge is significantly smaller than in the 3D charge.

Figure 10:
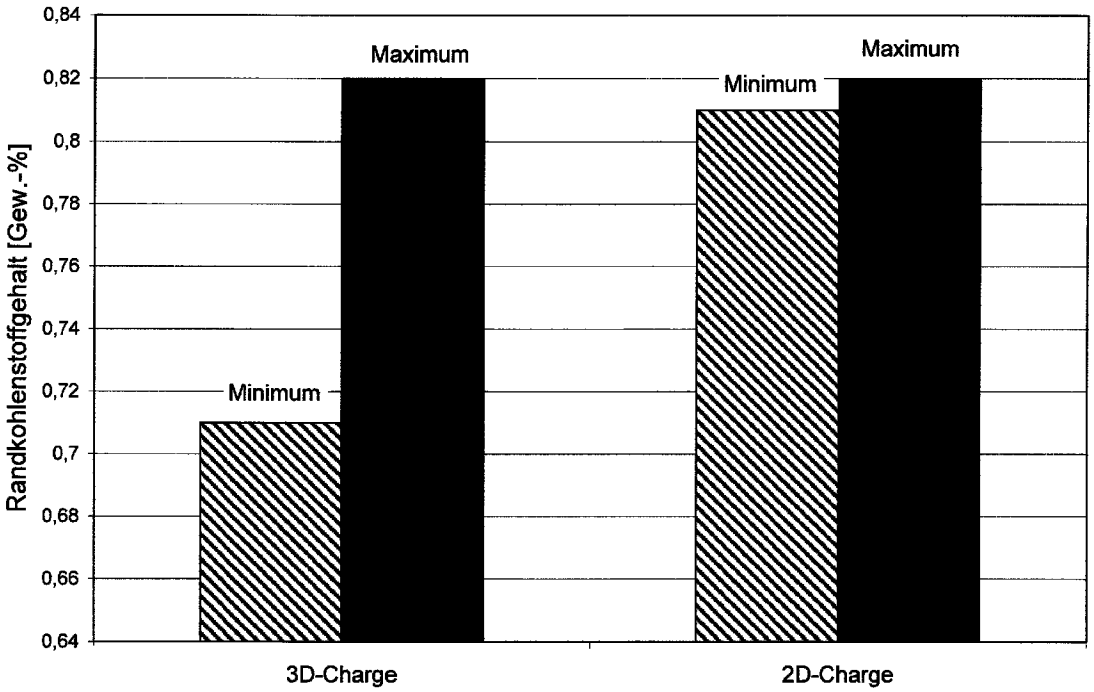
FIG. 10 shows measured data relating to the surface carbon of workpieces.

FIG. 10 shows a comparison of the variation of the surface carbon content of the 2D charge according to the invention and of the conventionally carburized 3D charge. The surface carbon content was determined, as described above, by spectral analysis, SIMS and EPMA on a ground surface by integrating the carbon signal over a depth range of 0 to 100 μm.

Example 2

Hollow wheels made of the material 28Cr4 and having an outer diameter of 140 mm, a height of 28 mm and 98 teeth were used to compile a 2D charge according to the invention, with one layer of 8 pieces with an overall weight of 6.5 kg, and a 3D charge, with 10 layers each with 8 pieces, i.e. 80 pieces with an overall weight of 65 kg. As the charging rack for one layer, structurally identical mesh grids made of CFC and having the dimensions 450 mm×600 mm were used both for the 2D charge and for the 3D charge.

Figure 11:
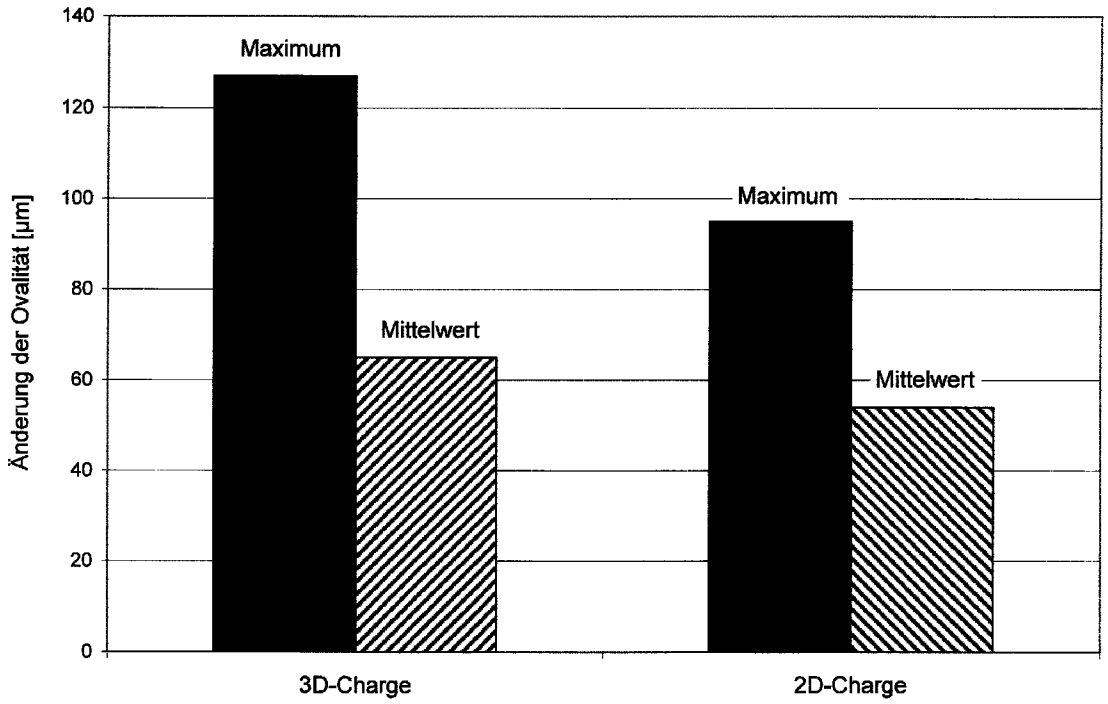
FIG. 11 shows measured data relating to the ovality of workpieces.

FIG. 11 shows the measurement results for the thermal distortion or the change in ovality of 8 hollow wheels from the 2D charge and of 8 hollow wheels from the 3D charge. In this respect, the positions of the 8 hollow wheels of the 2D charge and of the 8 hollow wheels of the 3D charge were distributed uniformly over the area or the volume of the 2D and 3D charges. The ovality was measured on the outer circumference of the hollow wheels before and after carburization by means of a 3D coordinate measurement system, and the difference in the ovality values before and after carburization was formed.

The invention claimed is:

1. A device for hardening metallic workpieces comprising a rack designed to hold workpieces arranged in one layer or row, two or more carburizing chambers, at least one cooling chamber, a lock chamber arranged between the carburizing chambers and the cooling chamber, and a transfer system for handling racks for the workpieces, wherein the cooling chamber can be connected to the lock chamber via a vacuum gate valve, each of the carburizing chambers can be connected to the lock chamber via thermal insulation gate valves, and each of the carburizing chambers has a receptacle for the rack and at least two heating elements consisting of graphite or carbon-fiber-reinforced carbon, said heating elements positioned to emit radiation directly onto the surface of each of the workpieces at an average solid angle of 0.5 π to 2 π, and said heating elements are meandering heaters having a U-shaped serpentine form disposed on a bottom side and a top side of each of the carburizing chambers, wherein the lock chamber further comprises a rack repository, and the cycle time based on one workpiece is 5 to 120 seconds.

2. The device as claimed in claim 1, wherein the thermal insulation gate valves are vacuum gate valves.

3. The device as claimed in claim 1, wherein the transfer system comprises vertically arranged chain drives with upper and lower guides and chains and also a horizontally movable telescopic fork for receiving pallets, wherein the telescopic fork is coupled to one of the chains via a gearing mechanism.

4. The device for hardening workpieces as claimed in claim 1, wherein the racks are grid-like pallets.

5. The device for hardening workpieces as claimed in claim 4, wherein the pallets have an opening ratio of greater than 60%.

6. The device for hardening workpieces as claimed in claim 5, wherein the racks consist of carbon-fiber-reinforced carbon.

7. The device for hardening workpieces as claimed in claim 1, wherein the carburizing chambers further comprise a multilayer lining of graphite plate as a heat-storing material and graphite felt as a thermally insulating material.

8. The device for hardening workpieces as claimed in claim 1, wherein said parking receptacle is arranged vertically relative to the carburizing chambers.

9. The device for hardening workpieces as claimed in claim 1, wherein said cooling chamber, said lock chamber and said carburizing chamber are evacuated independently of one another.

10. The device for hardening workpieces as claimed in claim 1, wherein said device comprises chambers consisting of said carburizing chambers, at least one cooling chamber and said lock chamber.

11. The device for hardening workpieces as claimed in claim 1, wherein said rack is selected from a grid-like pallet, frame with suspension brackets or a support plate with spikes or bores.

12. A hardening system comprising (i) metallic workpieces arranged in a single layer on a grid-like pallet having an opening ratio of greater than 60% and (ii) a device for hardening workpieces comprising four or more carburizing chambers, at least One cooling chamber, a lock chamber arranged between the carburizing chambers and the cooling chamber, a transfer system, and a pallet repository, wherein die cooling chamber can be connected to the lock chamber via a vacuum gate valve, each of the carburizing chamber can be connected to the lock chamber via thermal insulation gate valves, and each of the carburizing chambers consists essentially of (i) lined walls; (ii) a gate valve; (iii) a receptacle for the grid-like pallet and (iv) at least two heating elements consisting of graphite or carbon-fiber-reinforced carbon and (v) connections far gas and vacuum, said heating elements positioned to emit radiation directly onto the surface of each of the workpieces at an average solid angle of 0.5 π to 2 π and said heating elements are meandering heaters having a U-shaped serpentine form disposed on a bottom side and a top side of each of the carburizing chambers, wherein the cycle time based on one workpiece is 5 to 120 seconds.

* * * * *